US006450072B1

(12) United States Patent
Koester

(10) Patent No.: US 6,450,072 B1
(45) Date of Patent: Sep. 17, 2002

(54) CLUTCH BALL ADJUSTER FOR TAPPET SETTING

(75) Inventor: Karsten G. Koester, Plain City, OH (US)

(73) Assignee: Honda of America Mfg., Inc., Marysville, OH (US)

( * ) Notice: Subject to any disclaimer, the term of this patent is extended or adjusted under 35 U.S.C. 154(b) by 0 days.

(21) Appl. No.: 09/694,232

(22) Filed: Oct. 23, 2000

(51) Int. Cl.[7] ..... B25B 23/157
(52) U.S. Cl. ..... 81/476; 81/9.24
(58) Field of Search ..... 81/9.24, 467, 473, 81/476

(56) References Cited

U.S. PATENT DOCUMENTS

| | | | |
|---|---|---|---|
| 1,564,342 | A | 12/1925 | Gebhardt et al. |
| 1,654,319 | A | 12/1927 | Brown |
| 1,876,990 | A | 9/1932 | Lormor |
| 1,885,579 | A | 11/1932 | Boynton |
| 2,007,432 | A | 7/1935 | Mancuso |
| 2,194,069 | A | 3/1940 | Gagne |
| 2,449,034 | A | 9/1948 | Zimmerman |
| 2,544,834 | A | 3/1951 | Hancock |
| 2,566,543 | A | 9/1951 | Weglarz |
| 2,570,230 | A | 10/1951 | Hammond |
| 2,601,796 | A | 7/1952 | Palesh, Jr. |
| 2,732,746 | A | 1/1956 | Livermont |
| 2,872,004 | A | 2/1959 | Barker et al. |
| 2,948,173 | A | 8/1960 | Herrmann |
| 2,977,832 | A | 4/1961 | Bless |
| 3,717,053 | A | 2/1973 | Sturges |
| 4,229,999 | A | 10/1980 | Rottigni |
| 4,774,864 | A | 10/1988 | Dossier |
| 5,746,298 | A | 5/1998 | Krivec et al. |

*Primary Examiner*—D. S. Meislin
(74) *Attorney, Agent, or Firm*—Rankin, Hill, Porter & Clark LLP; Alan T. McDonald; Vincent Ciamacco

(57) ABSTRACT

A tappet screw adjuster having an outer sleeve, an inner shaft, a bearing block, a handle, and a rotary coupling disposed between the bearing block and the inner shaft. The rotary coupling is designed such that the bearing block and inner shaft rotate together when a load on the inner shaft is below a predetermined level and such that the bearing block and inner shaft do not rotate together when the load on the inner shaft exceeds the predetermined level. The rotary coupling includes a tension setting device, which is threadably secured to the bearing block, and a friction plate. The friction plate includes an annular projection that is received within a groove provided on the tension setting device.

11 Claims, 6 Drawing Sheets

CLUTCH BALL ADJUSTER FOR TAPPET SETTING

BACKGROUND OF THE INVENTION

1. Field of the Invention

The present invention is generally directed toward manufacturing methods and, more particularly, toward a method and device for setting a tappet screw.

2. Description of Related Art

Tappet clearance is the distance between a bottom surface of an adjustment or tappet screw and an upper surface of a valve. Different methods and devices for setting tappet clearance are known in the art. One such automatic method for setting tappet clearance involves a method of sensing valve movement and controlling a tappet screw setting in response to sensed valve position.

Methods and devices for manually adjusting tappet screws are also known in the art. When using such devices, it is a common practice for an assembler to walk along and manually adjust the tappet clearance as the engine travels on the assembly line. In accordance with one conventional method, the crankshaft/cam is put in the proper angular orientation, and feeler gauges are inserted between the camshaft and the rocker arm. Thereafter, the tappet screw is rotated or adjusted toward the valve to open the valve. This rotation of the tappet screw continues until the valve spring exhibits a biasing force of a predetermined value against the tappet screw. Accordingly, this method requires a device to turn the tappet screw, and such device must react to the biasing force or load such that further rotation of the tappet screw is prevented upon development of the predetermined valve spring force.

With reference to FIG. 13, a device 100 used in the aforementioned conventional method is shown to include an inner shaft 102, an outer sleeve 104, a bearing block 106, and a dome-shaped handle 108. The outer sleeve 104 includes, at a distal end 110, a nut-receiving socket 112 and, at a proximal end 114, a T-bar type handle 116 that extends radially in opposite directions.

The inner shaft 102 extends through outer sleeve 104 such that a distal end 118 of the inner shaft 102 has a common-type screwdriver head 120 disposed at an open base of the nut-receiving socket 112. The opposite or proximal end 122 of the inner shaft 102 projects outwardly from the proximal end 114 of the outer sleeve 104. Near the proximal end 122, the inner shaft 102 includes a first radially enlarged area to which the proximal end 114 of the outer sleeve 104 is secured, and a second radially enlarged area 126 to which a handle base 128 is secured.

A detent plate 130 is secured adjacent the second radially enlarged area 126 and the inner shaft proximal end 122. The detent plate is affixed to the inner shaft 102 and is essentially captured between the handle base 128 and the bearing block 106. The detent plate 130 includes a series of detents or recesses 132, which are adapted to receive spring-biased balls 134 that are secured in the bearing block 106. The proximal end 122 of the inner shaft 102 defines a longitudinally-extending mounting portion that the bearing block 106 is secured over.

The bearing block 106 provides a center passage that accommodates first and second bearings 137. The bearings 137 rotatably receive the mounting portion of the inner shaft proximal end 122. The dome-shaped handle 108 is affixed over the bearing block 106 for grasping and rotation thereof by the user. The balls 134 are secured in a face or surface at a first end of the bearing block 106.

The balls 134 are biased by springs 136 in a direction away from the bearing block 106 and toward the distal ends of the outer and inner shafts. The balls 134 are received in the detents 132 provided by the detent plate 130. The engagement between the balls 134 and the detent plate 130 serves as the driving connection between the bearing block/handle and the inner shaft 102. The level of spring bias is adjustable by, for example, adjustment screws 138.

Accordingly, with the device illustrated in FIG. 13, and with reference to the valve actuation system illustrated in FIG. 1, rotation of the tappet screw is accomplished by rotating the handle 108. The tappet screw engages the valve and forces the valve stem toward the engine cylinder against the bias of the valve spring. When the force of the valve spring reaches a predetermined desired level (i.e., the load on the inner shaft), the biasing force of the spring-loaded balls is overcome, and the balls 134 slip from the detents 132, giving the worker tactile and aural feedback that the desired pre-load has been accomplished.

Unfortunately, rotation of the handle 108 past the point wherein the balls 134 initially slip from the detents 132, causes the balls 134 to quickly and repeatedly seat into the detents and unseat from the detents. The repeated engagement/disengagement of the balls with the detents is believed to cause the screwdriver to be further rotated or driven, and thus over-driven. This belief is based upon the fact that use of the device illustrated in FIG. 13 has created inconsistent and non-repeatable results.

Therefore, there exists a need in the art for a device to overcome or minimize the deficiencies in the art and properly set the tappet screw. Accordingly, there exists a need in the art for a device for manually setting tappet clearance that will have repeatable, consistent results. There also exists a need in the art for a method for manually setting tappet clearance or preload.

SUMMARY OF THE INVENTION

The present invention is directed toward removing or minimizing the above-noted problems in the art and toward providing an improved method and device for setting tappet screw clearance. The present invention is further directed toward an improved method and device for manually setting tappet clearance or preload that will have repeatable, consistent results.

In accordance with the present invention, a tappet screw adjusting device includes an outer sleeve, an inner shaft, a bearing block, a handle, and a load-responsive assembly between the bearing block and the inner shaft. The load-responsive assembly is designed such that, when the load on the inner shaft is below a predetermined level the bearing block and the said inner shaft are coupled for common rotation. Alternatively, when the load on the inner shaft is above the predetermined level, the bearing block is rotated while the inner shaft remains stationary.

In further accordance with the present invention, the load-responsive assembly includes a friction plate and a tension setting device. The tension setting device is coupled to the bearing block while the friction plate is in frictional contact with a member that rotates with the inner shaft.

In further accordance with the present invention, the friction plate serves as a frictional coupling between the inner shaft and the tension setting device. The tension setting device is threadably secured to the bearing block, and the friction plate includes a projection that is received in a groove in the tension setting device. Therefore, rotary motion of the tension adjusting device is translated into axial movement of the friction plate.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS

Figure 1:
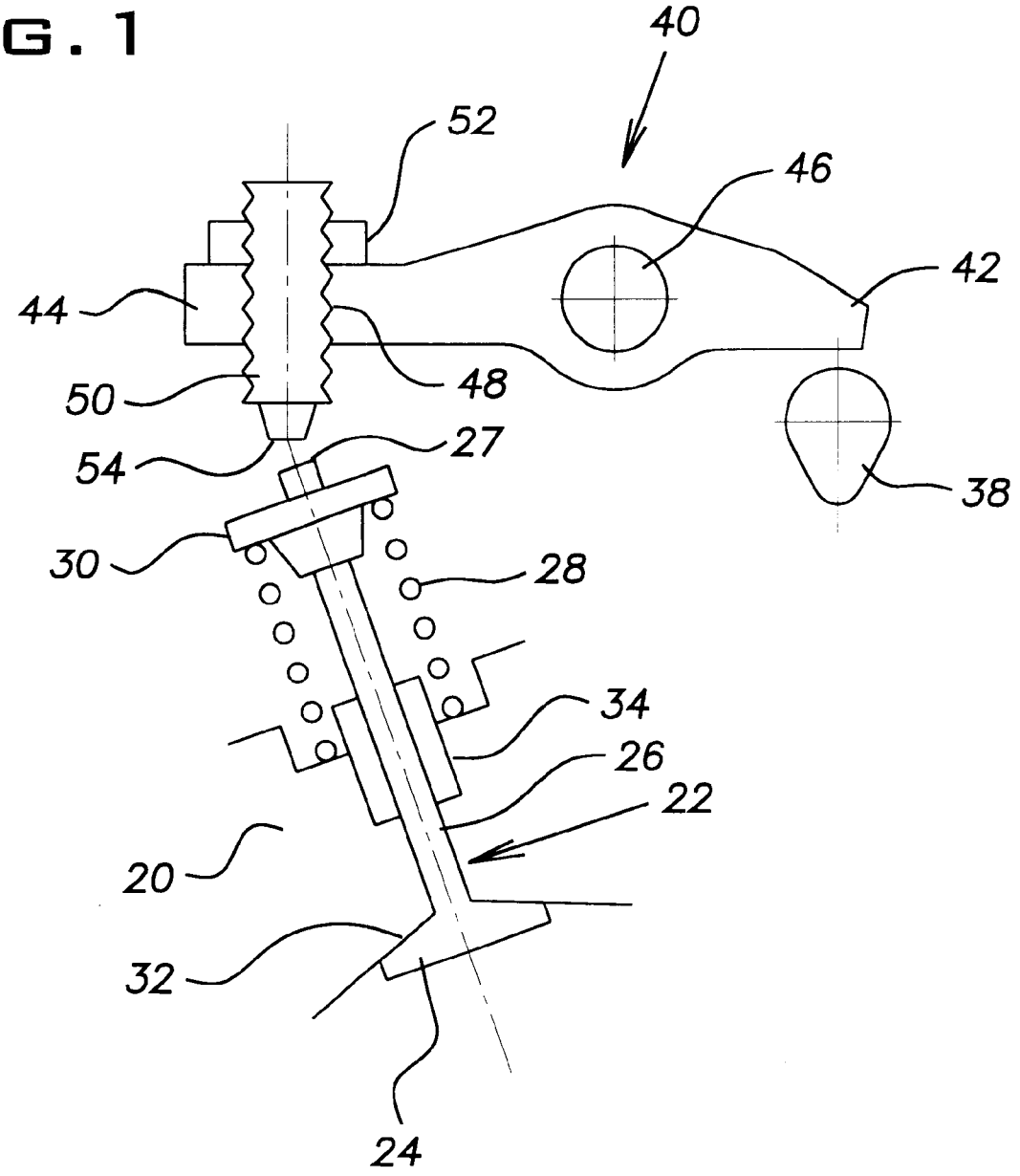
FIG. 1 schematically illustrates an engine valve actuation system.

It should be noted that in the detailed description which follows, identical components have the same reference numeral, regardless of whether they are shown in different embodiments of the present invention. It should also be noted that, in order to clearly and concisely disclose the present invention, the drawings may not necessarily be to scale and certain features of the invention may be shown in somewhat schematic form.

With reference to FIG. 1, a valve actuation system is illustrated. An engine generally includes a cylinder block (not shown) on which a cylinder head 20 is mounted. The cylinder head 20 has a plurality of intake and exhaust valves 22 disposed therein. With reference to FIG. 1, each valve 22 includes a valve head 24, a valve stem 26, a valve spring 28, and a valve retainer 30. The valve head 24 is biased, by the valve spring 28, toward a closed position in engagement with a seat 32 provided on the cylinder head 20. The valve stem 26 extends from the valve head 24 and through a valve guide 34 in the cylinder head 20. The valve retainer 30 is disposed on an end of the valve stem 26 opposite the valve head 24. The valve spring 28 surrounds the valve stem 26 and is captured between the valve retainer 30 and an outer surface of the cylinder head 20.

The cylinder head 20 also carries components that serve to controllably open and close the valves 22 in an ordered fashion. The components include a multi-lobe cam shaft 38 and a series of rocker arms 40, each rocker arm 40 being associated with one of the valves 22.

With continued reference to FIG. 1, each rocker arm 40, which includes a cam shaft end 42 and a valve end 44, is pivotally secured to a rocker arm shaft 46 that defines an axis of rocker arm rotation. The valve end 44 of the rocker arm 40 has a tapped hole 48 that threadably receives a tappet or adjustment screw 50. As the cam shaft 38 rotates, the rocker arm 40 pivots about its axis of rotation, and drives the tappet screw 50 into and out of engagement with the valve stem 26, thereby opening and closing the valve 22.

The tappet screw 50 has a tappet nut 52 thereon. After the tappet screw 50 is in a desired position or spacing relative to the valve stem 26, the tappet nut 52 is tightened to prevent unintended rotation of the tappet screw 50 relative to the rocker arm 40. Preferably, the tappet screw 50 has a very fine thread pitch to permit precise adjustment of the position of the lower end of the tappet screw 50 and, hence, tappet clearance. Rotation of the tappet screw 50 varies the spacing between a lower or engagement end 54 of the tappet screw 50 and an upper or engaged surface 27 of the valve stem 26, as will be described more fully hereinafter. Typically, setting of the tappet clearance is one of the final steps in engine assembly, and is performed with the cylinder head 20 installed on the cylinder block.

The tappet screw adjuster is described hereinafter relative to drawing FIGS. 2–12. With specific reference to FIG. 2, the adjuster 200 according to the present invention includes a inner shaft 202, an outer sleeve 204, a bearing block 207, and a dome-shaped handle 209. The outer sleeve 204 includes, at a distal end 210, a nut-receiving socket 212 and, at a proximal end 214, a T-bar type handle 216 that extends radially in opposite directions. The outer sleeve 204 is freely rotatably relative to the inner shaft 202, but is prevented from moving axially relative to the inner shaft.

The inner shaft 202 extends through outer sleeve 204 such that a distal end 218 of the inner shaft 202 has a common-type screwdriver head 220 disposed at an open base of the nut-receiving socket 212. The opposite or proximal end 222 of the inner shaft 202 projects outwardly from the proximal end 214 of the outer sleeve 204. Near the proximal end 222, the inner shaft 202 includes a first radially enlarged area 224 to which the proximal end 214 of the outer sleeve 204 is secured, and a second radially enlarged area 226 to which a handle base 228 is secured. The proximal end 214 of the outer sleeve 204 is preferably fixed to the first enlarged area 224 by means of a snap-ring type connection.

A disc-like member or collar 231 is secured adjacent the second radially enlarged area 226 and the inner shaft proximal end 222. The collar 231 is affixed to the inner shaft 202 and is essentially positioned between the handle base 228 and the bearing block 207. The collar 231 is fixed to the inner shaft 202 for common rotation therewith, and is frictionally engaged by a friction plate 240, to be described hereafter. The collar 231 is preferably formed from a light-weight metal material, such as aluminum. The proximal end 222 of the inner shaft 202 defines a longitudinally-extending mounting portion that the bearing block 207 is secured over, and attached to by means of a screw.

The bearing block 207 provides a center passage that accommodates first and second bearings 237. The bearings 237 rotatably receive the mounting portion of the inner shaft proximal end 222. The bearing block 207 also provides a threaded exterior surface 236 at the end facing the distal end of the inner shaft 202 for purposes that will be apparent from the following description.

A ring-shaped friction plate 240 and a tension setting device or preload nut 242 are disposed around the threaded exterior surface 236 of the bearing block 207. The tension setting device 242 has a threaded bore by means of which the tension setting device 242 is threadably secured to the exterior threaded surface 236 of the bearing block 207.

Figure 2:
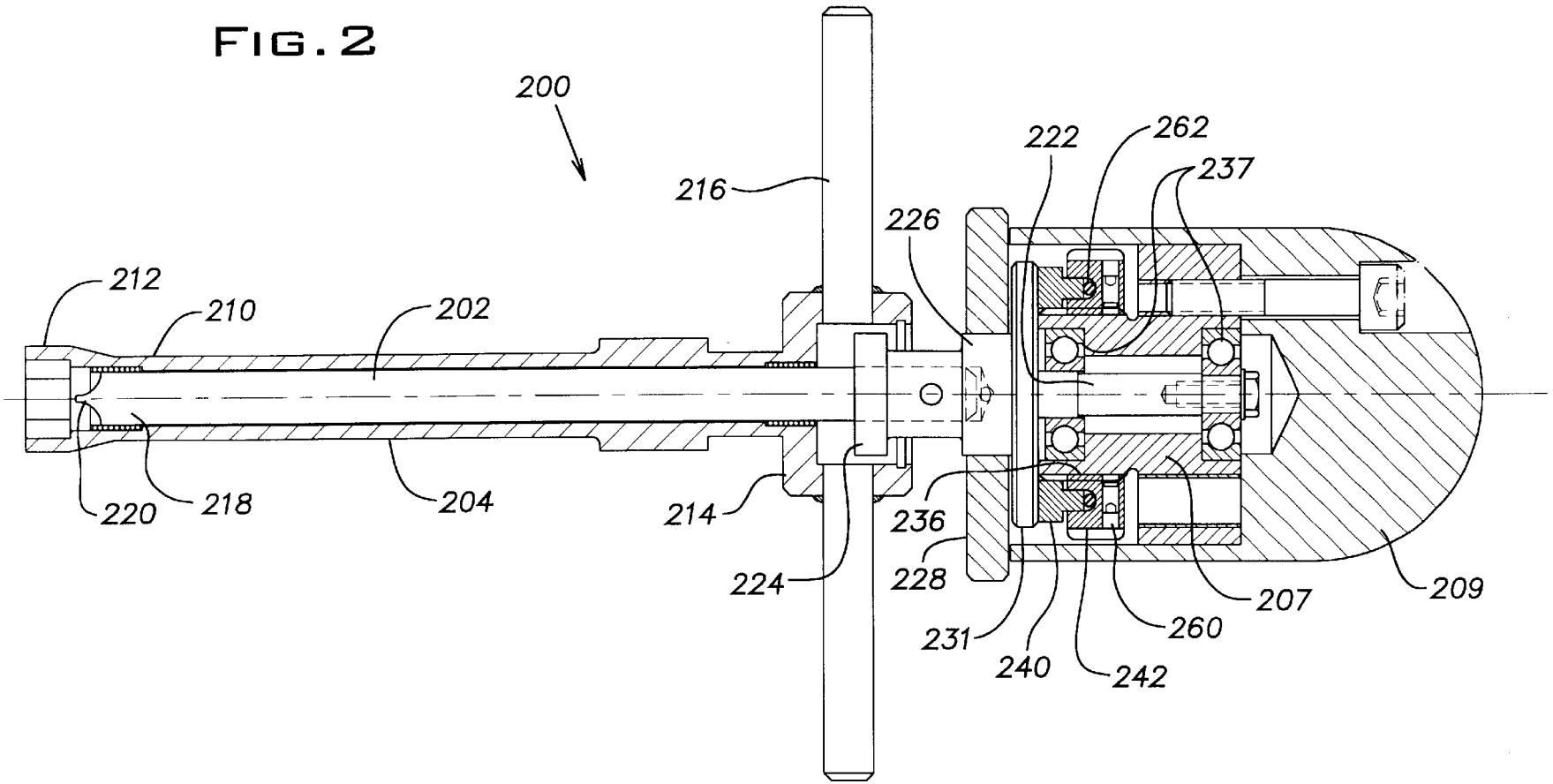
FIG. 2 is a longitudinal cross sectional view of the adjuster according to the present invention.
Figure 3:
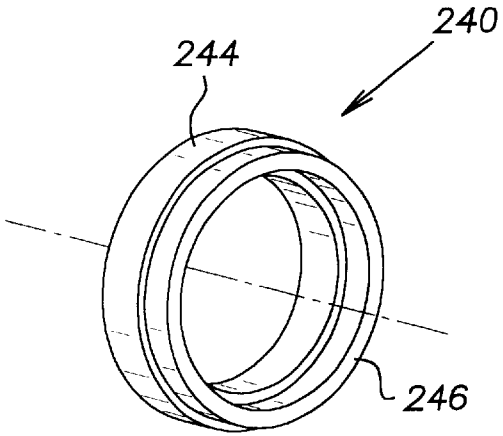
FIG. 3 is a perspective view of a friction plate that is incorporated into the adjuster.
Figure 6:
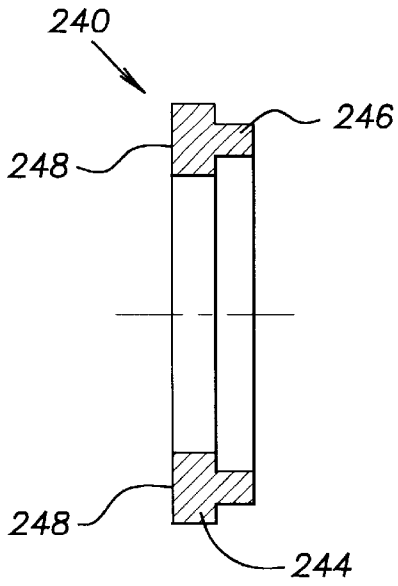
FIG. 6 is a cross-sectional view of the friction plate as seen through line 6—6 of FIG. 7.
Figure 7:
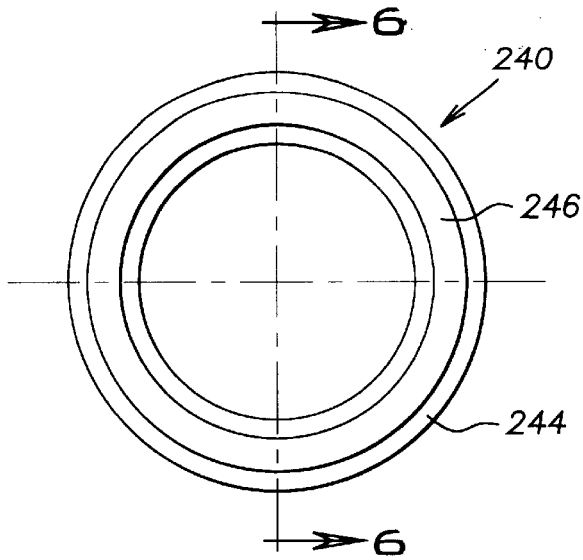
FIG. 7 is a top plan view of the friction plate.
Figure 8:
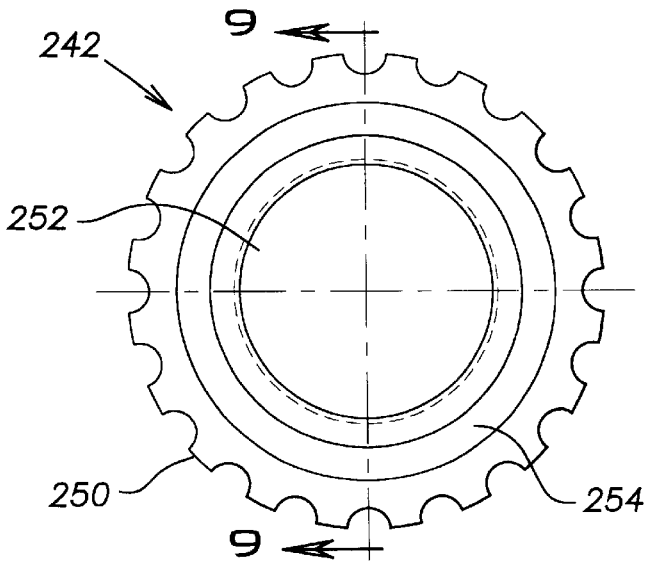
FIG. 8 is a top plan view of the tension setting device.
Figure 9:
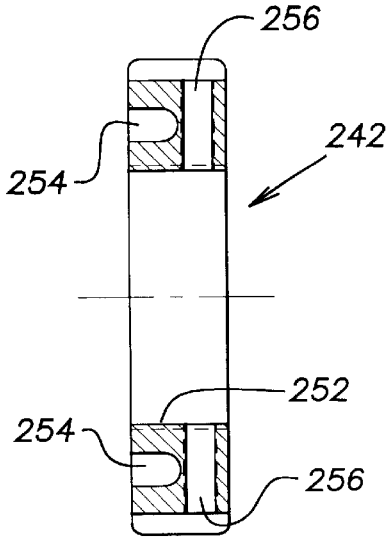
FIG. 9 is a cross-sectional view of the tension setting device as seen along line 9—9 of FIG. 8.
Figure 10:
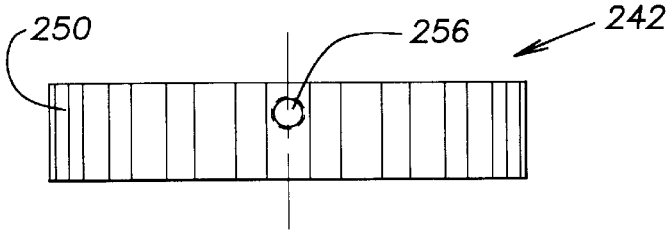
FIG. 10 is a front elevational view of the tension setting device.

The friction plate 240 is further illustrated in FIGS. 3, 6 and 7. As illustrated, the friction plate 240 includes a generally annular body member 244 from which a generally annular projection or alignment member 246 axially extends. The annular body member 244 provides a face 248 that is adapted to frictionally engage the collar 231. The annular alignment member 246 is in engagement with the tension setting device 242. As shown best in FIG. 2, the face 248 is directed toward the collar 231 and the annular alignment member faces away from the collar 231.

The friction plate 240 is preferably formed from a bearing grade polyimide plastic such as Vespel Sp-211. Such a material has physical properties that are advantageous in this environment. For example, the low coefficient of friction of this material prevents any sticking/slipping problems that may otherwise occur. Moreover, since the static coefficient of this material is less than its dynamic coefficient of friction, this material facilitates determination and establishment of a threshold wherein, after the correct preload has been set and the device is overrunning (slipping), any additional attempts by the operator to add more torque and consequently more force to the valve stem will fail.

The tension setting device 242 is further illustrated in FIGS. 4 and 8–10. As illustrated, the tension setting device 242 includes a corrugated circular outer surface 250, a central bore 252, an annular groove 254 that surrounds the central bore 252, and a pair of aligned bores 256 that extend transverse to the central bore 252. The central bore 252 is threaded to permit threaded engagement between the tension setting device 242 and the bearing block 207. The corrugated circular outer surface 250 facilitates hand-tightening and rotary adjustment of the tension setting device relative to the bearing block 207. The annular groove 254 receives the annular projection or alignment member 246 of the friction plate 240. The pair of aligned bores 256 are adapted to receive threaded fasteners, such as set screws 260 (FIG. 2). The set screws 260 engage or abut the bearing block 207, and ensure that the tension setting device 242 and bearing block 207 remain in a desired relative position.

An annular seal member or O-ring 262 is preferably disposed at a base or closed end of the annular groove 254, as illustrated best in FIG. 2. The O-ring 262 preferably is of medium hardness (e.g. Shore A-50 durometer). The O-ring 262 is operable to transmit preload forces from the tension setting device 242 to the friction plate 240. The O-ring 262 allows the friction plate 240 to float and align itself squarely to the collar 231, thereby permitting a uniform axial force transfer. The O-ring 262 also serves to generate a frictional resistant force between the tension setting device 242 and the friction plate 240 and, therefore, acts as a rotational coupler. Thus, the O-ring 262 assures that slippage only occurs between the collar 231 and the friction plate 240 and not between the tension setting device 242 and the friction plate 240.

Figure 5:
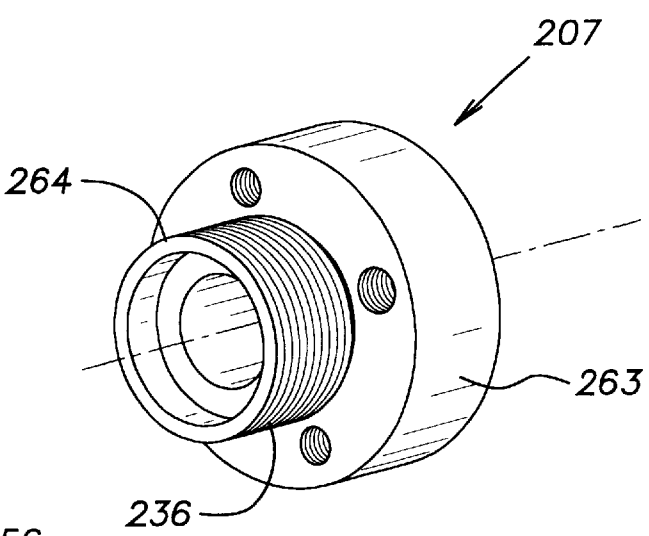
FIG. 5 is a perspective view of a bearing block that is incorporated into the adjuster.
Figure 4:
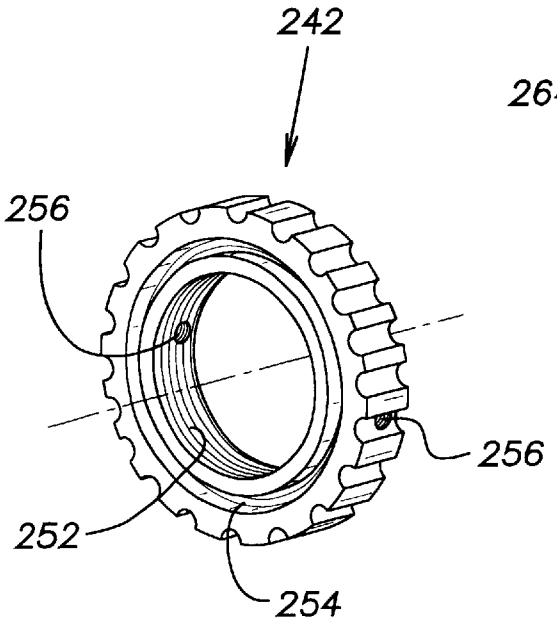
FIG. 4 is a perspective view of a preload member or tension setting device that is incorporated into the adjuster.
Figure 11:
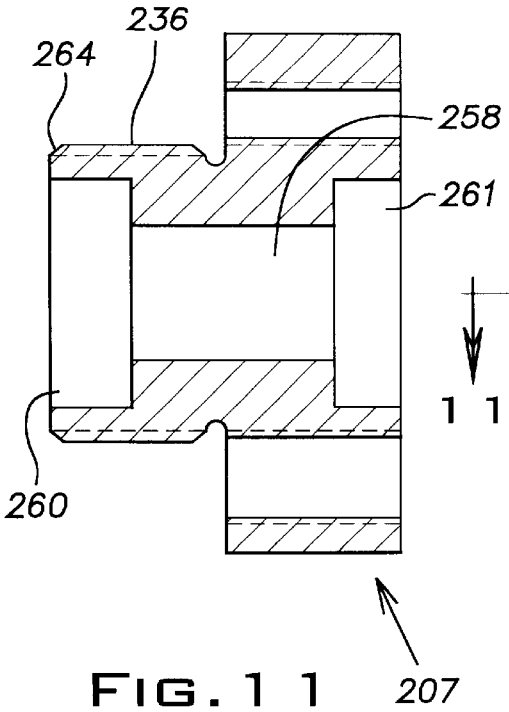
FIG. 11 is a cross-sectional view of the bearing block as seen along line 11—11 of FIG. 12.
Figure 12:
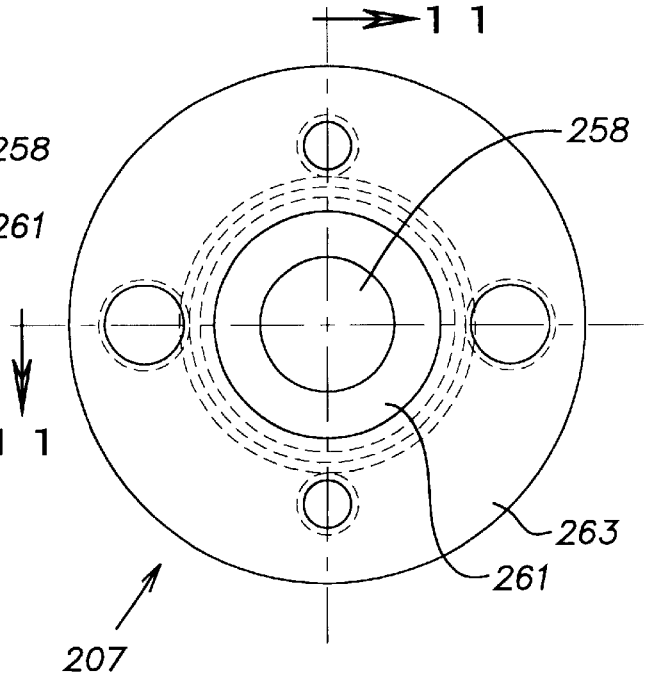
FIG. 12 is a top plan view of the bearing block.
Figure 13:
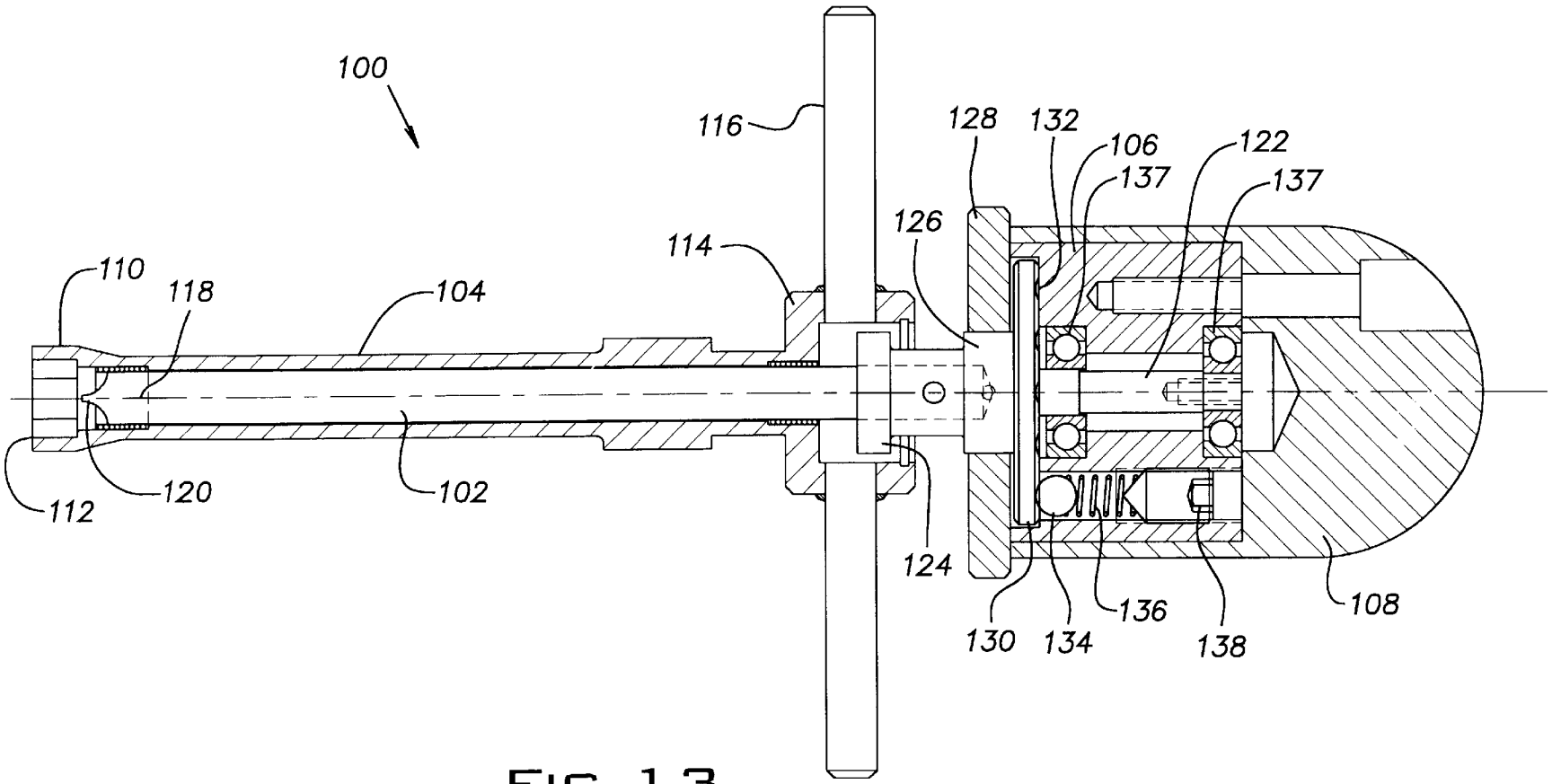
FIG. 13 PRIOR ART
FIG. 13 is a cross-sectional view of a conventional tappet screw adjuster.

The bearing block 207 is further illustrated in FIGS. 5, 11, and 12. The bearing block 207 includes a central bore 258 having recesses 260, 261 at opposite ends thereof for receipt of the bearings 237. A proximal end 263 of the bearing block 207 is radially enlarged, as compared to an externally threaded distal end 264. The externally threaded distal end 264 of the bearing block 207 receives the tension setting device 242, as discussed hereinbefore. A series of threaded bores are provided by the bearing block 207 to permit securement of the dome-shaped handle 209 thereto.

The tappet screw adjuster 200 works in the following manner. With a leave of a feeler gauge inserted between the cam 38 and the cam shaft end 42 of the rocker arm 40, the tappet screw 50 is engaged by the screwdriver 220 of the inner shaft 202. Rotation of the handle 209 is transmitted, via the bearing block 207, tension adjusting device 242, O-ring 262, friction plate 240, collar 231, and inner shaft 202 to turn the tappet screw 50 toward and into engagement with the valve stem 26. The tension adjusting device 242, O-ring 262, and friction plate 240 essentially serve as a rotary coupling between the bearing block and the inner shaft (collar). Further rotation of the tappet screw 50 causes the valve spring 28 to compress and, when the tappet screw 50 is at the desired position, the load on the inner shaft 202 as a result of the valve spring compression is at a predetermined level or value. The axial position of the tension adjusting device 242 is set so that, at the predetermined level of inner shaft load, the frictional engagement or coupling between the friction plate 240 and the collar 231 fails. Accordingly, the inner shaft is no longer rotatably coupled to the handle and the bearing block. The user therefore recognizes that the tappet screw 50 is at the desired setting, and then secures the tappet nut 52 by use of the outer sleeve 204 and handle 216, to prevent unintended alteration of the tappet screw position.

While the preferred embodiment of the present invention is shown and described herein, it is to be understood that the same is not so limited but shall over and include any and all modifications thereof which all within the purview of the invention.

What is claimed is:

1. A tappet screw adjusting device, comprising:

an outer sleeve having a distal end that defies a nut socket;

an inner shaft axially-aligned with said outer sleeve and having a distal end that defines a screwdriver bit, said inner shaft having a proximal end;

a bearing block that rotatably receives the proximal end of said inner shaft, said bearing block being secured to a handle for common rotation therewith;

a load-responsive assembly comprising a collar and a tension setting device, said collar being secured to said inner shaft for common rotation therewith, said tension setting device being secured to said bearing block for common rotation therewith;

wherein, when a load on said inner shaft is below a predetermined level, the tension setting device is frictionally coupled to said collar and thereby connects the bearing block to the inner shaft for common rotation and, when the load on said shaft is above said predetermined level, the tension setting device is uncoupled from the collar so that the inner shaft remains stationary when the bearing block is rotated, and wherein frictional coupling and uncoupling of said tension setting device and collar is correlated to said predetermined load level and adjusted by changing a position of said tension setting device on said bearing block; and, wherein the load-responsive assembly further comprises a friction plate, said friction plate being disposed between said collar and said tension setting device and serving to frictionally couple the collar and to the tension setting device when the load on the inner shaft is below said predetermined level.

2. The tappet screw adjusting device according to claim 1, wherein said tension setting device is threadably secured to said bearing block and wherein rotation of said tension setting device moves said tension setting device axially along said bearing block relatively toward and away from said collar.

3. The tappet screw adjusting device according to claim 1, wherein said tension setting device is annular and disposed around a portion of said bearing block, and alteration of an axial position of said tension setting device relative to said bearing block correspondingly alters the predetermined load level.

4. The tappet screw adjusting device according to claim 3, wherein the tension setting device defines an annular groove into which an annular protrusion from said friction plate extends, engagement between said annular protrusion and said annular groove causing said friction plate to move axially relative to said inner shaft upon rotary manipulation of said tension setting device.

5. The tappet screw adjusting device according to claim 4, wherein an O-ring is disposed in the annular groove and is operable to prevent slippage of the frictional connection between the tension setting device and said friction plate.

6. The tappet screw adjusting device according to claim 2, wherein said tension setting device is annular and disposed around a portion of said beating block, and alteration of an axial position of said tension setting device relative to said bearing block correspondingly alters the predetermined load level.

7. The tappet screw adjusting device according to claim 6, wherein the tension setting device defines an annular groove into which an annular protrusion from said friction plate extends, engagement between said annular protrusion and said annular groove causing said friction plate to move axially relative to said inner shaft upon rotary manipulation of said tension setting device.

8. The tappet screw adjusting device according to claim 7, wherein an O-ring is disposed in the annular groove and is operable to prevent slippage of the frictional connection between the tension setting device and said friction plate.

9. A tappet screw adjusting device, comprising:

an outer sleeve having a distal end that defines a nut socket;

an inner shaft axially-aligned with said outer sleeve and having a distal end that defines a screwdriver bit, said inner shaft having a proximal end;

a bearing block that rotatably receives the proximal end of said inner shaft, said bearing block being secured to a handle for common rotation therewith; wherein the improvement comprises:

a load-responsive coupling disposed between the inner shaft and the bearing block, the load-responsive coupling comprising a disc-like member secured to the inner shaft, a friction plate in frictional engagement with the disc-like member, and a tension setting device that is threadably secured to the bearing block, said load-responsive coupling being frictionally coupled to the inner shaft such that, when the load experienced by the inner shaft is less than a predetermined level, the inner shaft is rotatably coupled to the bearing block and, when the load on said shaft is above said predetermined level, said inner shaft is uncoupled from said bearing block and said bearing block is rotatable independently of said inner shaft, said predetermined level being determined by the position of said tension setting device relative to said disc-like member.

10. The tappet screw adjusting device according to claim 9, wherein the tension setting device defines a groove and the friction plate defines a projection that fits within the groove, frictional coupling of the tension setting device and the friction plate via the groove and the projection permit axial adjustment of said friction plate by rotation of said tension setting device.

11. The tappet screw adjusting device according to claim 9, wherein an O-ring is disposed in the annular groove and is operable to prevent slippage of the frictional connection between the tension setting device and said friction plate.

* * * * *